United States Patent [19]

Leuning

[11] Patent Number: 4,504,014

[45] Date of Patent: Mar. 12, 1985

[54] DEVICE FOR ATOMIZING A LIQUID

[75] Inventor: Wilfred D. Leuning, Sioux Falls, S. Dak.

[73] Assignee: D & W Industries, Inc., Sioux Falls, S. Dak.

[21] Appl. No.: 462,323

[22] Filed: Jan. 31, 1983

[51] Int. Cl.[3] ..... B05B 7/00; B05B 15/00

[52] U.S. Cl. ..... 239/433; 239/DIG. 7; 239/434; 239/547

[58] Field of Search ..... 239/455, 318, 547, 433, 239/434, 550, 601, DIG. 7; 222/575

[56] References Cited

U.S. PATENT DOCUMENTS 2,551,538 1/1948 Hensel ..... 239/550 X 2,907,557 9/1956 Coanda ..... 239/434 X

FOREIGN PATENT DOCUMENTS 676966 2/1948 United Kingdom ..... 239/318

*Primary Examiner*—Andres Kashnikow

*Assistant Examiner*—Kevin Patrick Weldon

*Attorney, Agent, or Firm*—Merchant, Gould, Smith, Edell, Welter & Schmidt

[57] ABSTRACT

A device (10) for atomizing a liquid is disclosed. The device (10) includes a sprayhead (14) receiving blown air through conduit (26) from boom (12). The air flows over wing 44 to create a region of reduced pressure within rectangular opening (64). A single stream of liquid is projected into opening (64) from where it flows over the secondary wing to trailing edge (54) for breakup and atomization within the vortex and turbulent flow following wing (44). Sprayhead (14) has a pair of elliptical nozzles (30, 32) superimposed on and orthogonally oriented with respect to one another to provide a proper projection pattern.

4 Claims, 7 Drawing Figures

FIG. 4
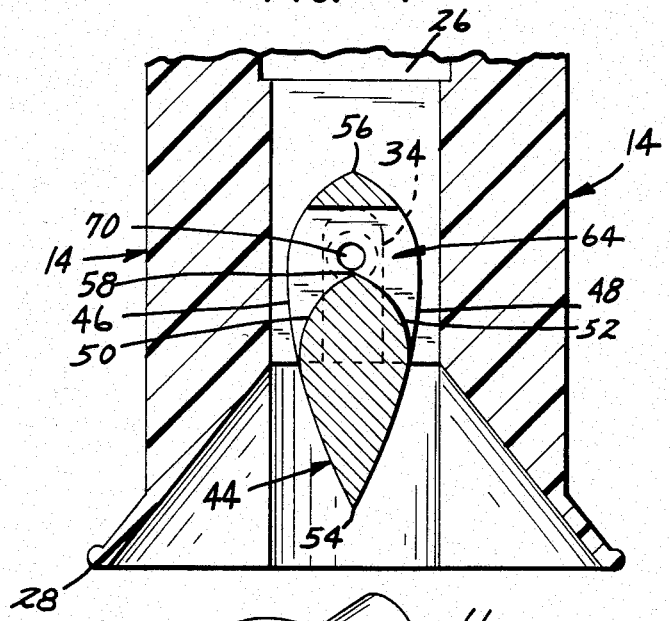
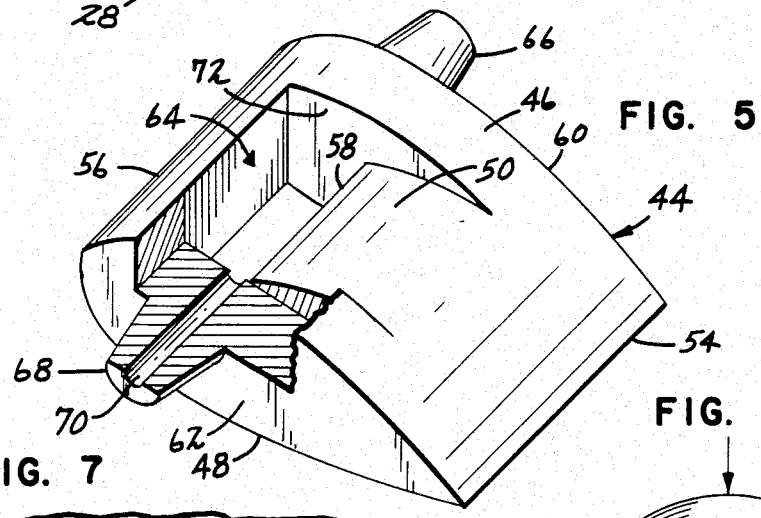
FIG. 5
FIG. 6
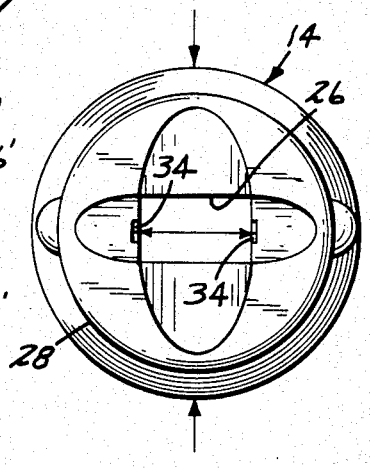
FIG. 7
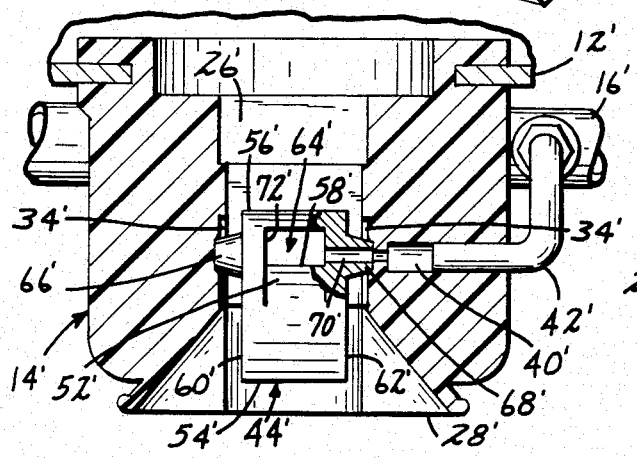

DEVICE FOR ATOMIZING A LIQUID

TECHNICAL FIELD

This invention relates to spraying equipment and, more particularly, to that part of a sprayer which ejects and atomizes a stream of liquid.

BACKGROUND OF THE INVENTION

For crops having heavy foliage, such as, potatoes, tomatoes, sugar beets, beans, cabbage, broccoli, cotton, etc., it is commonly necessary to spray chemicals for the control of insects and diseases in such a way that the chemicals reach the underside of the leaf. This is a difficult problem for most sprayer designs. U.S. Pat. No. 2,770,501 discloses a mechanism which, when used on a sprayer, accomplishes coverage on the underside of leaves. The mechanism, however, has been somewhat inefficient and, consequently, not widely accepted.

U.S. Pat. No. 2,770,501 discloses use of a wing placed in a conduit through which air is forced. Oppositely directed streams of liquid chemical are ejected into a triangular opening extending from top to bottom through the central part of the wing. The base portion of the triangular opening forms the leading edge of a second wing profile which extends rearwardly to conform to the profile of the larger wing profile. Although chemical trails rearwardly along the upper and lower surfaces of the wing to be atomized within the vortex and subsequent turbulent flow trailing the wing, a significant amount of chemical apparently does not properly follow this pattern. Large droplets or amounts of chemical drop onto the ground and are not properly utilized. Apparently, the impacting of the two oppositely directed streams against one another cause certain amounts of chemicals to be ejected from the reduced pressure region so that the chemical does not trail along the wing surfaces.

SUMMARY OF THE INVENTION

The present invention is directed to a device for atomizing a liquid. The device includes a conduit with a nozzle forming an end thereof and a wing attached to the wall of the conduit. The wing is located wholly within space enclosed by the conduit and the nozzle. The wing has a substantially symmetrical profile including an extrados with a first leading edge and an intrados with a second leading edge. A rectangular opening extends through the wing between the first and second leading edges and between opposite sides of the wing. As air blows through the conduit past the wing, the rectangular opening creates a zone of reduced pressure. The device further includes a mechanism for directing a single jet of liquid into the zone of reduced pressure.

More particularly, the present invention is commonly embodied in a plurality of sprayheads spaced apart along a boom. The boom may be hollow for confining pressurized air between the air source and the conduit of each sprayhead, or the boom may support a tube which directs pressurized air to each sprayhead. Similarly, the boom may contain or support a tube which directs the liquid to be atomized from a liquid bulk container to each sprayhead. Each sprayhead commonly includes a conduit leading to a nozzle portion. Elliptical nozzles superimposed and orthogonally oriented with respect to one another provide a particularly effective ejection opening. The wing is attached to the sprayhead by slightly compressing the sprayhead in the vertical direction to allow nipples on either side of the wing to slide along the conduit wall and project into detents in the sprayhead. The tube from the bulk liquid container leads to an opening in the sprayhead at one of the detents which is in fluid communication with an opening through the mating nipple, which opening in turn extends through the wing to the zone of reduced pressure within the wing. A preferable relationship of the wing with respect to the nozzle portion of the sprayhead exists when the trailing edge of the wing is somewhat inside the plane of the open end of the sprayhead nozzle.

The present invention ejects a single spray of liquid along the leading edge of the intrados profile of the wing. The stream of liquid is peeled away as it proceeds along the edge so that only a portion of the stream impacts the far wall and rebounds throughout the zone of reduced pressure. The flow pattern of the stream of liquid is much more orderly than the collision of oppositely directed streams of liquid in the device of U.S. Pat. No. 2,770,501. The laminar sheet of liquid which attaches to the wing surface is much more uniform and includes a greater portion of the total stream of liquid.

A substantial portion of the wing is located within the conduit portion of the sprayhead with only the trailing end of the wing being within the nozzle portion of the sprayhead such that the trailing edge does not extend beyond the nozzle opening. Such relationship is particularly advantageous in confining the air flow with respect to the wing surface and subsequently creating the necessary turbulence for atomization.

The orthogonal, superimposed elliptical nozzles further enhance the efficiency of the atomization. The elliptical nozzle with an axis parallel with the wing provides an air flow which expands along the trailing surfaces of the wing thereby helping to expand the laminar sheets of liquid to get better atomization in the vortex and the turbulent flow following. The elliptical nozzle having an axis perpendicular to the wing carries any liquid bouncing away from the wing surfaces outwardly from the wing along the direction of travel of the sprayer thus providing a bigger distribution pattern in the direction of the row of the crop. By keeping the trailing edge of the wing inside the nozzle, the vortex trailing the wing is located just outside the nozzle and creates turbulence at the location just outside the nozzle to effectively breakup liquid not only trailing off the wing but any liquid which may not be flowing along the wing.

Thus, the present invention significantly improves the atomization efficiency of a sprayhead using a wing therein. Such increased efficiency often translates to fewer passes over a field while providing greater crop yield.

These advantages and other objects obtained by the use of the invention are further explained and may be better understood by reference to the drawings which form a further part of this disclosure and to the descriptive matter hereinafter in which there is described in more detail a preferred embodiment of the invention.

BRIEF DESCRIPTION OF THE DRAWINGS

FIG. 4 is a cross-sectional view, taken along line 4—4 of FIG. 2;

FIG. 5 is a perspective view of a wing in accordance with the present invention;

FIG. 6 is an end view of a sprayhead in accordance with the present invention; and FIG. 7 is a cross-sectional view, similar to FIG. 2, showing an alternate embodiment.

DETAILED DESCRIPTION OF THE PREFERRED EMBODIMENT

Figure 1:
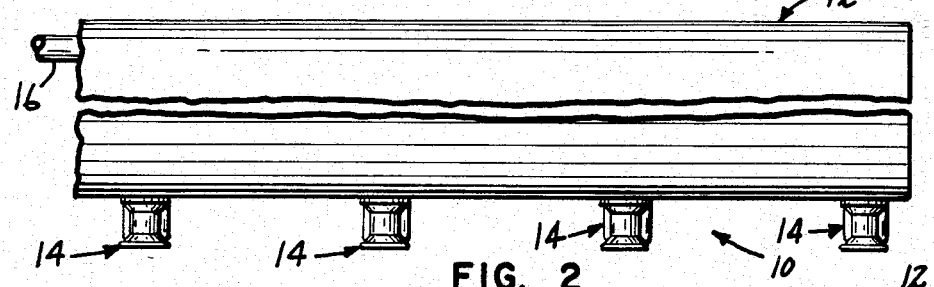
FIG. 1 is a side view of a boom holding a plurality of sprayheads.

Referring now to the drawings wherein like reference numerals designate identical or corresponding parts throughout the several views, and more particularly to FIG. 1, a device for atomizing a liquid in accordance with the present invention is designated generally as 10. Atomizing device 10 is commonly used on a field sprayer, but may be used for a variety of other applications wherein it is necessary to atomize a stream of liquid while ejecting it in combination with air. In the present embodiment, device 10 is shown as a boom 12 supporting a plurality of spaced-apart sprayheads 14.

Figure 2:
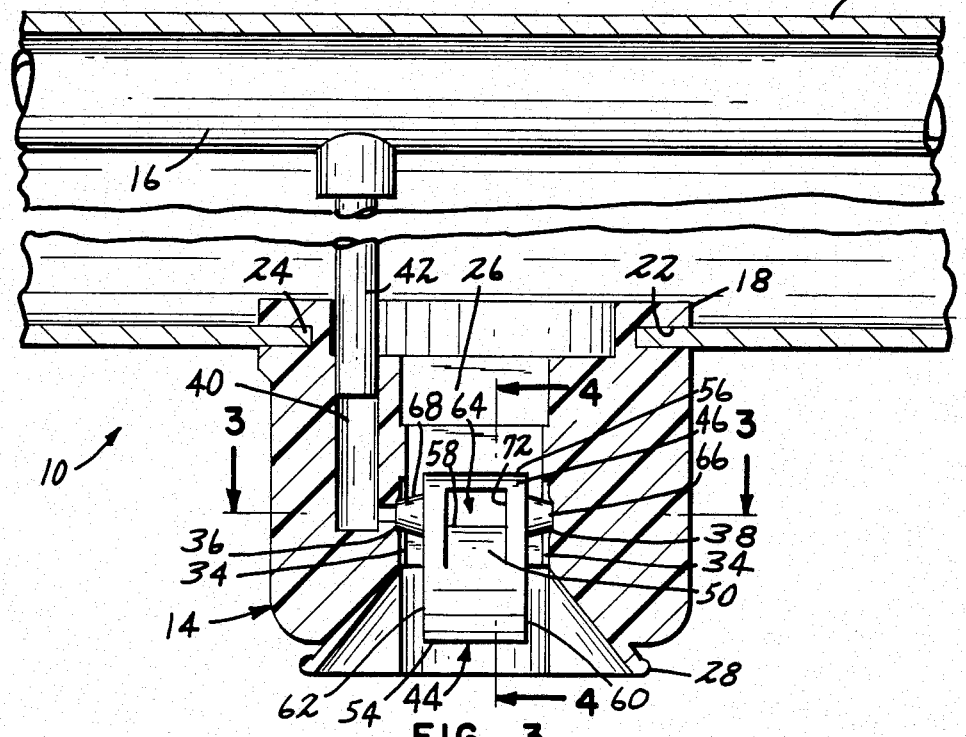
FIG. 2 is a cross-sectional view of the boom and one of the sprayheads.

As shown more clearly in FIG. 2, boom 12 is tubular or otherwise hollow to provide a mechanism for containing pressurized or blown air. In addition, boom 12 contains and supports a tube 16 for delivering liquid to the various sprayheads 14.

A sprayhead 14 includes a flange portion 18. Flange portion 18 provides a mechanism for attaching sprayhead 14 to boom 12. In the embodiment shown in FIG. 2, flange portion 18 includes a slot 22 within which the edge 24 of an opening in boom 12 fits, thereby supporting sprayhead 14. Sprayhead 14 includes a conduit 26 extending to a nozzle portion 28 which provides an opening to the atmosphere. Nozzle portion 28 is preferably formed by a pair of elliptical nozzles which are superimposed on and orthogonally oriented with respect to one another as shown in FIG. 6. Each of the orthogonal nozzles form side walls which are raised or lowered with respect to the rest of the side wall of nozzle portion 28. A pair of slots 34 extend from nozzle portion 28 along opposite walls of conduit 26. Slots 34 include detents 36 and 38 for mating with nipples 66 and 68 of wing 44 as described hereinafter. Sprayhead 14 includes a passage 40 in fluid communication with detent 36. Passage 40 receives a tube 42 which is connected to tube 16 which carries liquid from a bulk container (not shown).

Wing 44 is located within conduit 26 and nozzle portion 28. As shown in FIGS. 2–5, wing 44 has a substantially symmetrical profile with an extrados forming primary upper and lower surfaces 46 and 48. Wing 48 also has an intrados forming a secondary profile having upper and lower surfaces 50 and 52. The secondary profile forms a substantial symmetrical secondary wing within the shape of wing 44 with the intrados conforming to the shape of the extrados in the portion of the wing near trailing edge 54. Between leading edge 56 of wing 44 and leading edge 58 of the intrados profile forming the secondary wing and between the opposite sides 60 and 62 of wing 44, a rectangular opening 64 is formed. Rectangular opening 64 extends from top surface 46 to bottom surface 48 and is formed by three substantially vertical sides with respect to the horizontal plane about which wing 44 is symmetrical and a fourth side which is formed by the leading edge 58 of the intrados profile of the secondary wing. A pair of nipples 66 and 68 protrude from sides 60 and 62 of wing 44. Nipples 66 and 68 are shaped to conform to and be held frictionally within detents 36 and 38. Nipple 68 includes a passage or opening 70 which extends through it and a portion of wing 44 to rectangular opening 64.

Wing 44 has width relative to conduit 26 such that nipples 66 and 68 protrude a short distance from sides 60 and 62 of wing 44 so that the distance between the ends of nipples 66 and 68 is slightly greater than the distance separating the bottom walls of opposing slots 34 in conduit 26. Thus, sprayhead 14 may be slightly compressed to allow wing 14 to slide along slots 34 to detents 36 and 38. When sprayhead 14 is not so deformed, nipples 66 and 68 fit within detents 36 and 38 to frictionally hold wing 44 fixed relative to sprayhead 14. Wing 44 has length such that leading edge 56 is well within conduit 26 while trailing edge 54 remains within nozzle portion 28. Nipples 66 and 68 are preferably located such that passage 70 ejects liquid along leading edge 58 of the secondary wing profile.

Figure 3:
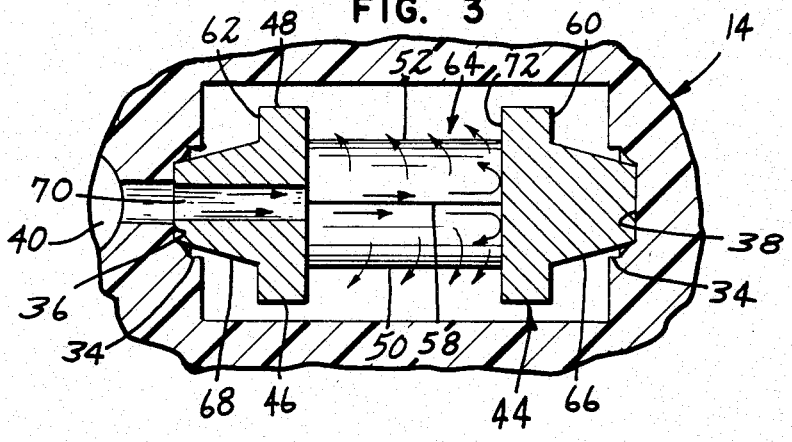
FIG. 3 is a cross-sectional view, taken along line 3—3 of FIG. 2.

FIG. 3 is illustrative of how a stream of liquid is ejected from passage 70 and how portions of the stream peel away and flow along the secondary wing profile yet leaving a portion of the stream to impact wall 72 of rectangular opening 64. The portion of the stream which impacts wall 72 rebounds with portions of the rebounding liquid joining the laminar flow along the secondary wing and other portions flying above the secondary wing to flow outwardly in a turbulent layer.

FIG. 7 shows alternate plumbing for directing the liquid to passage 70′ within wing 44′. That is, tube 16′ carrying liquid from a bulk container to the several sprayheads 14′ is supported on the outside of the boom 12′. Thus, tube 42′ is also external of boom 12′ and sprayhead 14′ between tube 16′ and a reinforced passage 40′ within sprayhead 14.

In use, air is forced under pressure or blown into conduit 26 of sprayhead 14. Likewise, liquid is forced under pressure into passage 40 and detent 36. With wing 44 fixed in the approximate spatial relationship described hereinbefore, the air passes about wing 44 creating a region of reduced pressure within rectangular opening 64. Liquid is projected from passage 70 along leading edge 78 of the secondary wing defined by the intrados profile. The liquid changes direction and its flow pattern approximately in accordance with the illustration of FIG. 3. Most of the liquid flows along a laminar layer on both sides of wing 44 toward trailing edge 54. As the liquid leaves trailing edge 54 it moves into the usual vortex and turbulent flow pattern which trails a wing. Within the vortex and turbulent pattern the liquid is broken down and atomized so that as it moves toward the dense foliage of the crop plants, it fills the space and attaches to both sides of the leaves and stems.

The rectangular opening 64 and the spatical relationship of wing 44 to nozzle portion 28 provide a particularly effective atomization resulting in highly efficient coating of dense foliage crop plants.

Although these numerous characteristics and advantages, together with details of structure and function have been set forth, it is to be understood that the above disclosure is illustrative. Consequently, changes made, especially in matters of shape, size, and arrangement, to the full extent extended by the general meaning of the terms in which the appended claims are expressed, are understood to be within the principle of the present invention.

What is claimed:

1. A device for atomizing a liquid, comprising:

means, attached to a boom, for confining air from an air source;

a sprayhead attached to said boom, said sprayhead including first and second elliptical nozzles superimposed on and orthogonally oriented with respect to one another, said sprayhead nozzles being in fluid communication with the air in said confining means;

a first wing with a substantially symmetrical first profile, said first wing having a top and a bottom, said first wing having first leading and first trailing edges, said first wing having a first opening extending through from said top to said bottom, said first opening having a side forming a second leading edge for a second wing, said second wing having a substantially symmetrical profile extending from said second leading edge to meet and conform to the first profile of said wing, one of said first and second elliptical nozzles having an axis aligned with said first and second wings;

means for attaching said first wing within said sprayhead; and means for directing a single jet of liquid into said first opening;

whereby the aligned elliptical nozzle helps expand air flow along the trailing edges of said wings while the orthogonal elliptical nozzle carries liquid outwardly away from said wings thereby providing a bigger distribution pattern.

2. A device in accordance wih claim 1 wherein said attaching means includes a pair of nipples attached on opposite sides of said first wing, said nipples for fitting within mating detents in said sprayhead.

3. A device in accordance with claim 2 wherein one of said detents is in fluid communication with a source of liquid and wherein said nipple which fits in said one detent has a second opening therethrough, said second opening extending through a portion of said first wing to provide fluid communication from said source of liquid through said one detent and said second opening to said first opening.

4. A device for atomizing a liquid comprising:

a hollow boom for confining air from an air source;

a sprayhead attached to said boom, said sprayhead including first and second elliptical nozzles superimposed on and orthogonally oriented with respect to one another, said sprayhead nozzles being in fluid communication through a conduit with the air in said boom, said conduit including a pair of facing detents, one of said detents being in fluid communication with a source of liquid;

a wing having a substantially symmetrical profile including an extrados with a first leading edge and an intrados with a second leading edge, one of said first and second elliptical nozzles having an axis aligned with said wing, said wing having a pair of opposite sides, said wing having a rectangular first opening through said wing between said opposite sides and between said first and second leading edges, said wing including a pair of nipples attached integrally on said opposite sides, said nipples for fitting within said detents in said sprayhead to hold said wing to said sprayhead, one of said nipples including a second opening extending through said wing to said first opening thereby placing said first opening in fluid communication with said source of liquid, said second opening having a centerline, said first opening having length parallel to said centerline of length sufficient so that fluid passing thereinto from said second opening peels away to join the air flow along the width of said second leading edge.

* * * * *

UNITED STATES PATENT AND TRADEMARK OFFICE

CERTIFICATE OF CORRECTION

PATENT NO. : 4,504,014

DATED : March 12, 1985

INVENTOR(S) : Wilfred D. Leuning

It is certified that error appears in the above-identified patent and that said Letters Patent is hereby corrected as shown below:

Column 4, line 36, delete "reinforced" and insert therefor --reoriented--.

Signed and Sealed this

*Twenty-third* Day of *July 1985*

[SEAL]

*Attest:*

DONALD J. QUIGG

*Attesting Officer* *Acting Commissioner of Patents and Trademarks*